US006929002B1

(12) United States Patent
Adrian

(10) Patent No.: US 6,929,002 B1
(45) Date of Patent: Aug. 16, 2005

(54) CONTAINER FOR PORTABLE HEATING EQUIPMENT

(75) Inventor: Trevor Adrian, Park City, UT (US)

(73) Assignee: TAPC, LLC, Park City, UT (US)

( * ) Notice: Subject to any disclaimer, the term of this patent is extended or adjusted under 35 U.S.C. 154(b) by 5 days.

(21) Appl. No.: 10/222,732

(22) Filed: Aug. 15, 2002

Related U.S. Application Data

(60) Provisional application No. 60/312,550, filed on Aug. 15, 2001.

(51) Int. Cl.[7] ..... F24C 3/08
(52) U.S. Cl. ..... 126/40; 431/343; 220/521
(58) Field of Search ..... 126/38, 40, 39 B; 431/343; 220/521, 212.5, 315, 318, 380; 206/45.2

(56) References Cited

U.S. PATENT DOCUMENTS

| | | | | |
|---|---|---|---|---|
| 1,302,911 | A * | 5/1919 | Gilbert | 126/38 |
| 1,926,230 | A * | 9/1933 | Epstein | 206/213 |
| 2,468,778 | A * | 5/1949 | Rasmussen | 126/38 |
| 3,709,198 | A | 1/1973 | Williams | |
| 3,730,165 | A | 5/1973 | Williams | |
| 3,738,351 | A | 6/1973 | Watts | |
| 3,768,458 | A | 10/1973 | Williams | |
| 3,925,828 | A | 12/1975 | Kim | |
| 4,268,248 | A | 5/1981 | Wilbur et al. | |
| 4,453,280 | A | 6/1984 | Greenleaf | |
| 4,667,484 | A * | 5/1987 | Tarozzi et al. | 62/371 |
| 5,111,538 | A | 5/1992 | Chapman | |
| 5,154,158 | A * | 10/1992 | Lindsey | 126/9 R |
| D337,815 | S | 7/1993 | Yoshida | |
| 5,251,345 | A | 10/1993 | Pechner | |
| 5,405,186 | A | 4/1995 | Hanson et al. | |
| 5,549,039 | A * | 8/1996 | Ito et al. | 99/340 |
| 5,678,255 | A * | 10/1997 | Stoudamire, Sr. | 4/516 |
| 5,730,311 | A * | 3/1998 | Curtis | 220/371 |
| 5,939,858 | A * | 8/1999 | Dodd et al. | 320/107 |

FOREIGN PATENT DOCUMENTS

| | | | |
|---|---|---|---|
| DE | 37 36 745 A1 * | 5/1989 | F24C 5/20 |

* cited by examiner

*Primary Examiner*—Josiah C. Cocks
(74) *Attorney, Agent, or Firm*—Workman Nydegger

(57) ABSTRACT

A container for heating equipment allows the equipment to be stored in a safe and secure environment, and to be easily transported to a wide variety of locations for use. The container is also used to support at least a portion of the equipment during the operation of the equipment. In particular, the container is preferably used with heating equipment such as portable water heaters, portable showers, and portable tent heaters. Advantageously, the body of the container is capable of storing water for the portable water heaters and portable showers, and the lid of the container is capable of retaining the portable water heater, shower or tent heater in the generally upright position.

30 Claims, 7 Drawing Sheets

CONTAINER FOR PORTABLE HEATING EQUIPMENT

CROSS-REFERENCE TO RELATED APPLICATIONS

This application claims the benefit of U.S. Provisional Application No. 60/312,550, filed Aug. 15, 2001 and entitled "Container for Portable Heating Equipment," which is hereby incorporated by reference.

BACKGROUND OF THE INVENTION

1. The Field of the Invention

The present invention generally relates to a container for portable heating equipment and, in particular, to a container that can be used to transport and store portable heating equipment when the equipment is not being used and which is also designed to support at least a portion of the portable heating equipment when it is being used.

2. Description of Related Art

The popularity of outdoor recreation in the United States has grown tremendously in recent years. An ever increasing number of outdoor activities have become more accessible to a greater number of people, resulting in a greater proportion of the general population spending more time in less developed and remote areas of the country. Persons who spend time in such remote areas are commonly referred to as "outdoor enthusiasts." Outdoor enthusiasts travel to remote areas to engage in recreational activities such as hiking, biking, camping, hunting, rock climbing, and mountain climbing.

This increased interest and participation in outdoor recreation has increased the demand for products that provide some of the comforts of modern living. For instance, portable tents of many shapes and sizes have been manufactured to provide privacy and shelter during camping and overnight excursions to remote outdoor areas. Additionally, products such as folding chairs, compact cooking apparatus, compact showering apparatus, backpacks, and portable food storage devices, such as coolers, enable outdoor enthusiasts to enjoy activities in remote areas while still enjoying some of the necessities or comforts of modern living. As a result, outdoor enthusiasts are seeking more of the modern comforts even during their recreational activities in remote areas.

Outdoor enthusiasts commonly desire to take portable heat sources for use in remote areas during their recreational activities. Various types of devices have been used for many years as portable heat sources, but heat sources that are truly portable and easy to use are not readily available. For example, a common concern for outdoor enthusiasts relates to keeping warm. Without the benefit of temperature-regulated buildings or structures, a person in a remote area is often subject to extreme temperature variations. Mountainous areas are a popular destination outdoor enthusiasts, yet, because of their high elevation, these areas often experience much lower temperatures than are comfortable, especially at night.

Portable heat sources, such as air heaters, are often used to help protect oneself from the low temperatures frequently encountered while in the outdoors and places where other sources of heat, such as electricity, are unavailable. These heaters are used to heat enclosures, such as tents, campers, trailers, tent trailers and the like. Various heaters are available, but they typically have multiple pieces, are awkward to carry and are not very "portable".

Another type of portable heat source, such as portable water heaters, is often used by outdoor enthusiasts to provide hot water for cooking and showering. Portable water heaters are desirable because outdoor enthusiasts that previously wanted hot water often had to use a cook stove or camp fire to heat a container of water, and that required a significant amount of time. For example, a camp fire or cook stove may take fifteen to twenty minutes, or more, to heat a gallon of water.

Portable heat sources, such as showers and hot water heaters or heaters for enclosed spaces such as tents, campers and the like, can be used in a variety of situations and locations. These portable heat sources have been used for many years, but are often not truly "portable." For example, these heat sources usually have multiple pieces and attachments which are necessary for use. These pieces and attachments are often easily lost, and are difficult to keep together so that all the pieces and attachments are accounted for when needed to operate the heat source.

In particular, conventional portable showers are often not truly portable because they are heavy, awkward to carry, and include a plurality of parts. For example, conventional portable showers often include a large housing that is divided into a number of compartments. One compartment is a large, watertight container that is used to hold the water for the shower, and the other compartments are used to hold various pieces of equipment such as a pump, power source, heat source, fuel for the heat source, hose, showerhead, etc. As a result, many of the conventional portable showers are not truly portable because they are heavy, large and awkward to move because the large water compartment is an integral part of the device, but separate from the compartments for storing the pump, power source, heat source, etc.

Portable showers with water containers that are not an integral part of the device are also known, but these water containers are not truly portable because they too are heavy and awkward. These portable showers use water containers to hold the water while the water is being heated. In particular, these types of known devices require the water container to be constructed from metal to allow heat to be transferred from the heat source to the water. Disadvantageously, metal water containers are heavy and often expensive to manufacture because of their customized shape. Such metal water containers are often made using thin sheets of metal in an attempt to minimize the weight of the container. However, the thin metal of these water containers is often easily damaged because it can be dented and disfigured, and metal water containers in general often rust or corrode over time. Further, these metal water containers are typically either large and, therefore, too heavy to be truly portable, or so small that the container cannot hold enough water sufficient for a shower. Further, these conventional portable showers often do not provide adequate hot water because, in an attempt to keep such showers lightweight and portable, the water containers are too small to hold a sufficient amount of water for use as a shower.

In a further attempt to keep these conventional water heaters portable, conventional portable water heaters typically have relatively small heat sources. However, these conventional portable showers also require all the water in the container to be heated before the device can be used as a shower. Thus, depending upon the size of the heat source and the size of the container, it can take up to thirty minutes or more to heat the water for a hot shower. Therefore, the size of the water container is further limited by the ability of the heat source to heat the container of water within an acceptable time frame. Disadvantageously, the heated water in the container, which is generally poorly insulated or not insulated at all, is constantly losing heat. This heat loss increases the time required to heat the water for a hot shower, further limiting the size of the water container. Therefore, the size of the water containers used in conventional portable showers is often limited in order to decrease the size and weight of the device and to decrease the time required to heat the water before use for showering.

Another problem with existing portable heating equipment is that when they are being used in a remote area, there often is not a convenient, flat surface to set up the fuel source and activate the portable heating equipment. If a place is chosen to set up the portable heating equipment that is not sufficiently flat or protected, the fuel source and even the whole heat source may tip over. This can potentially be very dangerous fire hazard. In addition to just the danger of burning the user, there is also the risk of starting the environment, tent, trailer or other structure on fire.

BRIEF SUMMARY OF THE INVENTION

A need therefore exists for a container for portable heating equipment that is truly convenient to use, lightweight, but large enough to accommodate the portable heating equipment and also eliminates the above-described problems.

The present invention is a container for portable heating equipment that allows a heat source and other equipment to be easily carried and transported. Advantageously, the container allows the portable heating equipment to be stored and transported in a safe, secure environment. In addition, the container is capable of performing one or more functions while the heating equipment is being used. For example, the container may be used to hold water when the portable heating equipment is being used as part of a portable water heater for a shower. Additionally, the container may be used to support all or a portion of the portable heating equipment in a generally upright position. Further, the container may be used with portable heating equipment that performs different functions, such as heating a tent or other type of enclosure, cooking, heating water for a hot shower, etc. Thus, the container is a multi-functional device that can be used to store and transport a variety of heating equipment, to retain and protect the heating equipment during use, and to hold a reservoir of fluid to be heated by the heating equipment.

One aspect of the container for portable heating equipment is it provides a container for transporting the heating equipment. The container is sized and configured to hold the various components of the portable heating equipment in a relatively small and compact area. In particular, the components of the portable heating equipment are typically disassembled and inserted into the container for convenience as well as to help prevent loss of any pieces or attachments of the heating equipment. Advantageously, the components of the portable heating system may be configured to be nested together to save space within the container. The container may, in some cases, also be sized and configured to hold the fuel source to be used as part of the heating assembly.

Another aspect of the container for portable heating equipment is the container provides protection for the heating equipment from damage or breakage. Desirably, the containers are constructed from a lightweight, durable material, such as plastic, to protect the heating equipment from damage during transportation. Advantageously, plastic containers are lightweight and rugged. The container also optionally forms a generally air tight and/or water tight seal when the lid is closed, thereby protecting the equipment from damage due to exposure to the elements during storage and transportation. Additionally, plastic containers are relatively inexpensive to manufacture because they can quickly and easily be molded or formed into the desired shape.

Yet another aspect of the container for portable heating equipment is that the containers are readily stackable. This allows several containers to be stacked to save space. For example, manufacturers and retailers who typically store large quantities of such containers, or even owners of multiple types of heating equipment, can save storage space because any suitable number of containers can be stacked one on top of the other.

Another aspect of the container for portable heating equipment is the container is readily usable in connection with portable water heaters, such as those used for portable hot showers, portable stoves, or portable air heaters. When the portable water heater is being used, the container can be used to hold a water supply to be heated by the portable water heater. Portable hot showers can also be used in many different locations such as in parks, cabins, recreational vehicles (RV's), boats, beaches, etc. Thus, portable hot showers can be used in a variety of outdoor environments, and also in conjunction with indoor environments such as cabins without electrical power or permanent water heaters.

In particular, the container is used with portable showers that heat the water as it flows to the user. When used with these portable showers, the container itself can hold water to be heated by the portable shower. These types of portable showers provide heated water very quickly and efficiently because an entire reservoir or container of water does not have to be heated before a hot shower can be taken. In particular, the container is preferably used with a portable shower in which water to be heated flows directly from the container through a heating assembly where it is heated, and then directly to the user without ever being stored or held in a container or reservoir once it has been heated. In particular, an inlet from the portable shower is then inserted into the container holding the water. A pump draws the water into the heating system of the shower and propels the water through a flexible tube or conduit to a heating assembly for use by the user. These types of water heaters do not require the container to transfer heat to the water. Therefore, the container can be made of a durable and lightweight material, such as plastic, and still serve as a water supply for the water heater. Further, such water heaters do not heat the entire reservoir of water all at once, so the size of the container is not limited by the heat source's ability to heat the water within an acceptable time frame. Thus, the size of the container is small and light enough to be truly portable, while still being large enough to store the portable water heater, and to hold an adequate amount of water for a shower when the water heater is in use.

In greater detail, the container is used to store the portable heating equipment in a safe and secure environment when it is not being used. The container is also used to transport the portable heating equipment. Typically, the portable heating equipment, such as a portable shower or air heater, is at least partially disassembled when it is stored and transported within the container. When a user desires to use the portable heating equipment, the lid is removed from the body of the container and the portable heating equipment is removed from inside the container. The portable heating equipment is then assembled. A portion of the portable heating equipment is placed in a recessed portion of the lid. Thus, the lid of the container provides a stable base for the portable heating equipment. Desirably, the recessed portion in the lid is sized and configured to receive a fuel source for the portable heating equipment. The fuel source, for example, may comprise one or more pressurized propane cylinders, which are held in a generally upright position. In particular, the lid is placed on a generally flat surface and the fuel source is securely held within the recessed portion in the lid. Thus, the lid acts as a base for the fuel source and safely holds the fuel source, and in some cases the heat source, in a relatively secure and stable position.

Advantageously, the container allows a portable shower or water heater to be used in almost any location or setting. For example, the container can be filled with water from a lake, pond, stream or river; culinary water supply, such as at a house or cabin; or other suitable source. Significantly, the container holds the water to allow the portable water heater to be used any time that hot water is desired, such as for showering, cooking or cleaning.

Significantly, the container may also be used to store a portable heater for heating enclosures, such as a tent, a camper, a trailer, a tent trailer and the like. The container holds the portable tent heater in a safe and secure environment for storage and transportation. Similar to use in conjunction with the portable water heater, the lid of the container can support at least a portion of the portable tent heater in a generally upright position during use of the device.

Still another aspect of the container for portable heating equipment is the container can support other portions of the equipment during use of the portable heating device. Desirably, the container may also be configured to support a fuel source or a power source, such as a battery pack, for the heating system.

Thus, the container provides a protective carrying case and stable support for portable heating equipment, such as air heaters and water heaters. The container is made of a high strength material, such as plastic, so as to be lightweight, rugged and easy to manufacture. The container can hold water to be heated when the container is used in conjunction with a portable water heater. These and other aspects, features and advantages of the present invention will become more fully apparent from the following description of the preferred embodiments and appended claims.

BRIEF DESCRIPTION OF THE DRAWINGS

The appended drawings contain figures of preferred embodiments of the container for portable heating equipment, which illustrate some of the above-recited and other aspects, features and advantages of the present invention. It will be appreciated, however, that the illustrated drawings only illustrate preferred embodiments of the invention and are not to be considered limiting of its scope. The invention will be described and explained with additional specificity and detail through the following figures.

DETAILED DESCRIPTION OF THE PREFERRED EMBODIMENTS

The present invention involves a container for portable heating equipment. More specifically, the present invention is a container for use with portable heating equipment, such as portable water heaters, portable air heaters, portable stoves and the like. Advantageously, the inventive container allows the portable heating equipment to be stored in a secure environment and transported to a variety of different locations. In addition, the container is capable of supporting at least a portion of the heating equipment in a desired and safe position while the portable heating equipment is in use. The principles of the present invention, however, are not limited to containers for portable heating equipment. It will be understood that, in light of the present disclosure, the container can be successfully used in connection with other types of devices and equipment.

Additionally, to assist in the description of the container for heating equipment, words such as top, bottom, front, rear, right and left are used to describe the accompanying figures. It will be appreciated, however, that the container can be located in a variety of desired positions—including upside down. A detailed description of the container now follows.

Figure 1:
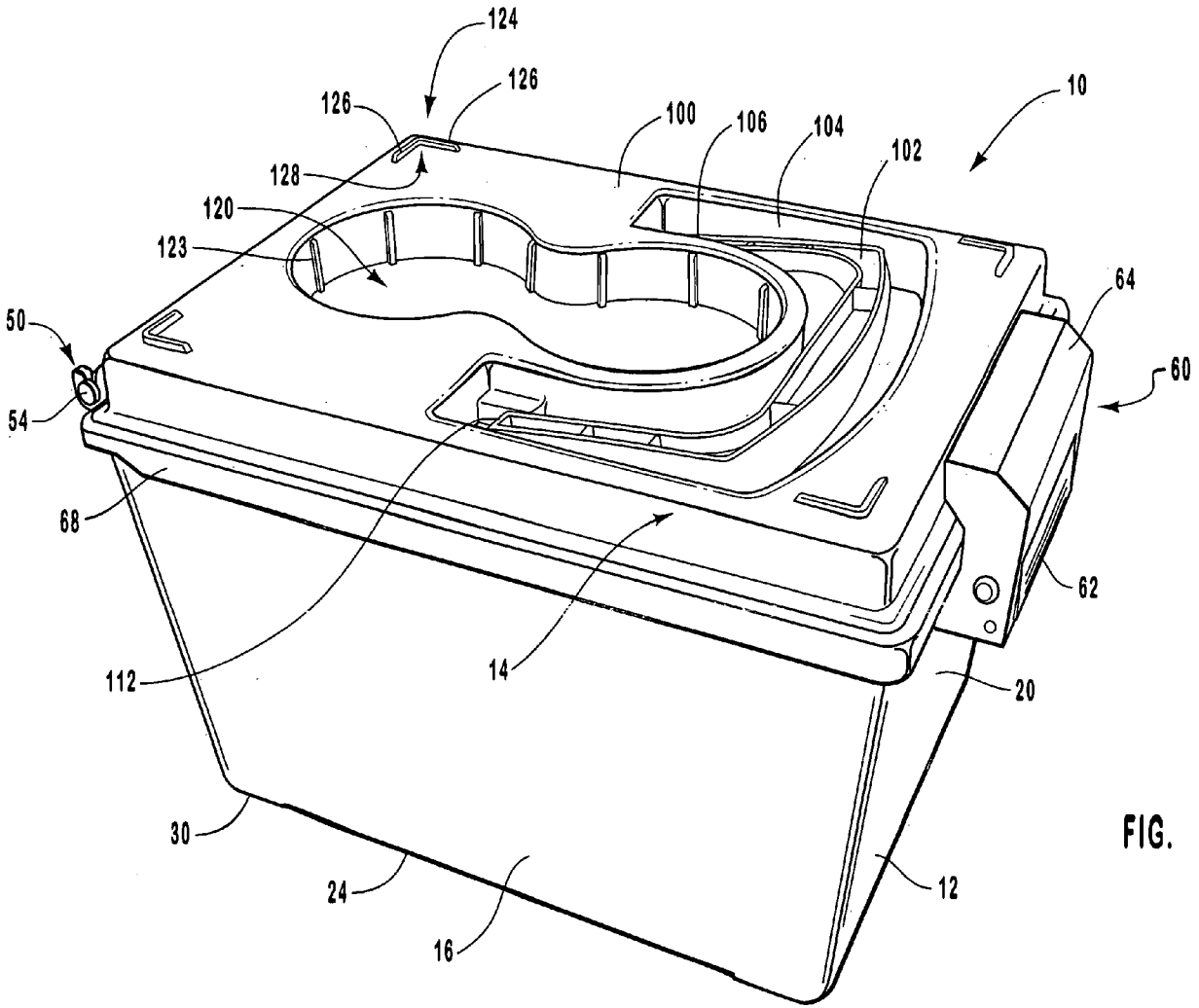
FIG. 1 is a perspective view of one embodiment of a container for portable heating equipment in illustrating the container in a closed position.
Figure 2:
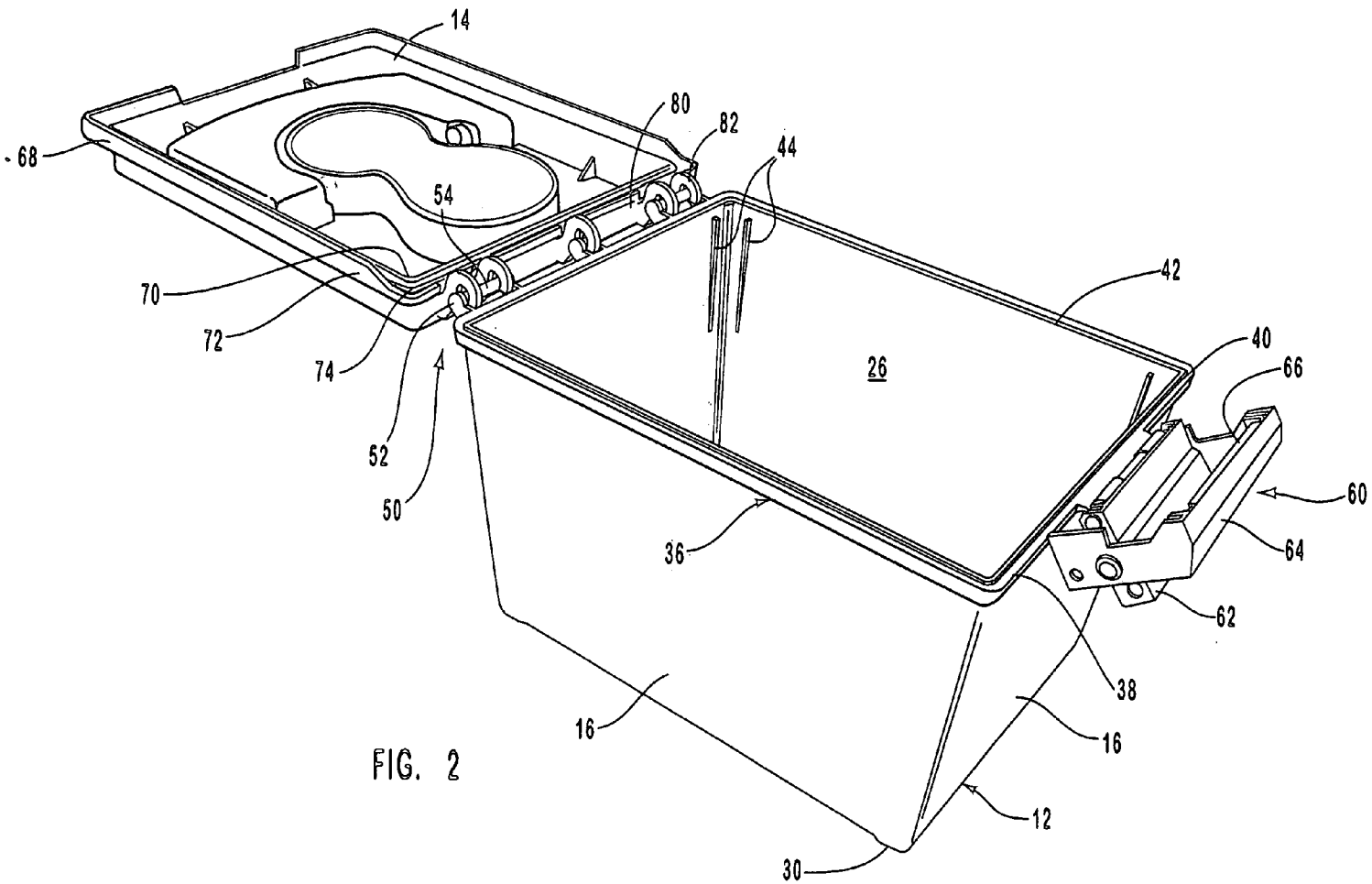
FIG. 2 is a perspective view of the container shown in FIG. 1, illustrating the container in an open position.

As illustrated in FIGS. 1 and 2, the container 10 for portable heating equipment includes a body 12 and a lid 14. In one embodiment, body 12 has a generally rectangular shape with generally upwardly extending walls 16, which generally define an enclosed interior space 26. It will be appreciated that body 12 may have various other shapes including by way of example and not limitation, square, round, oval, octagonal and the like.

In one possible embodiment, by way of example and not limitation, body 12 has a length of about 12 inches, a width of about 9 inches and a height of about 9 inches. It will be appreciated that body 12 may also have various other dimensions depending upon various factors such as the size of the equipment to be stored inside container 10 or the desired volume of enclosed space 26. Any one or all of the height, width and length may be varied without affecting the function thereof. It is contemplated, however, that the size of body 12 is limited inasmuch as container 10 is "portable."

Figure 3D:
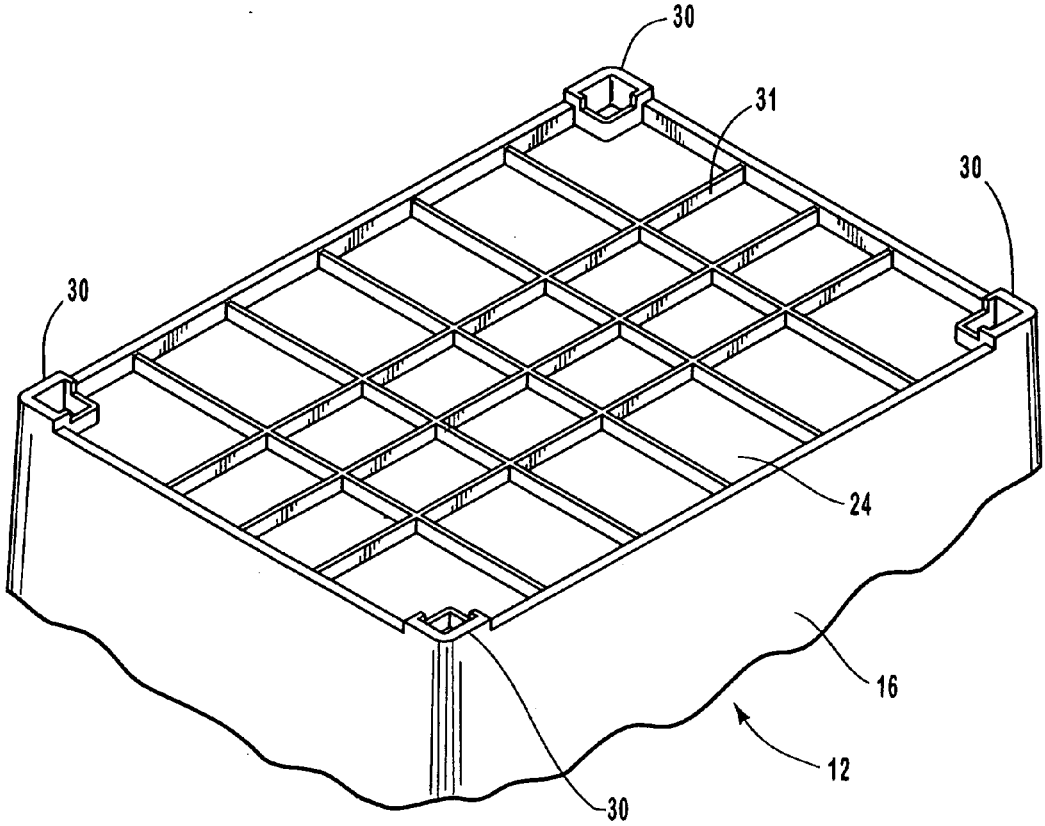
FIG. 3D is a partial perspective bottom view of the container of FIG. 1.
Figure 4:
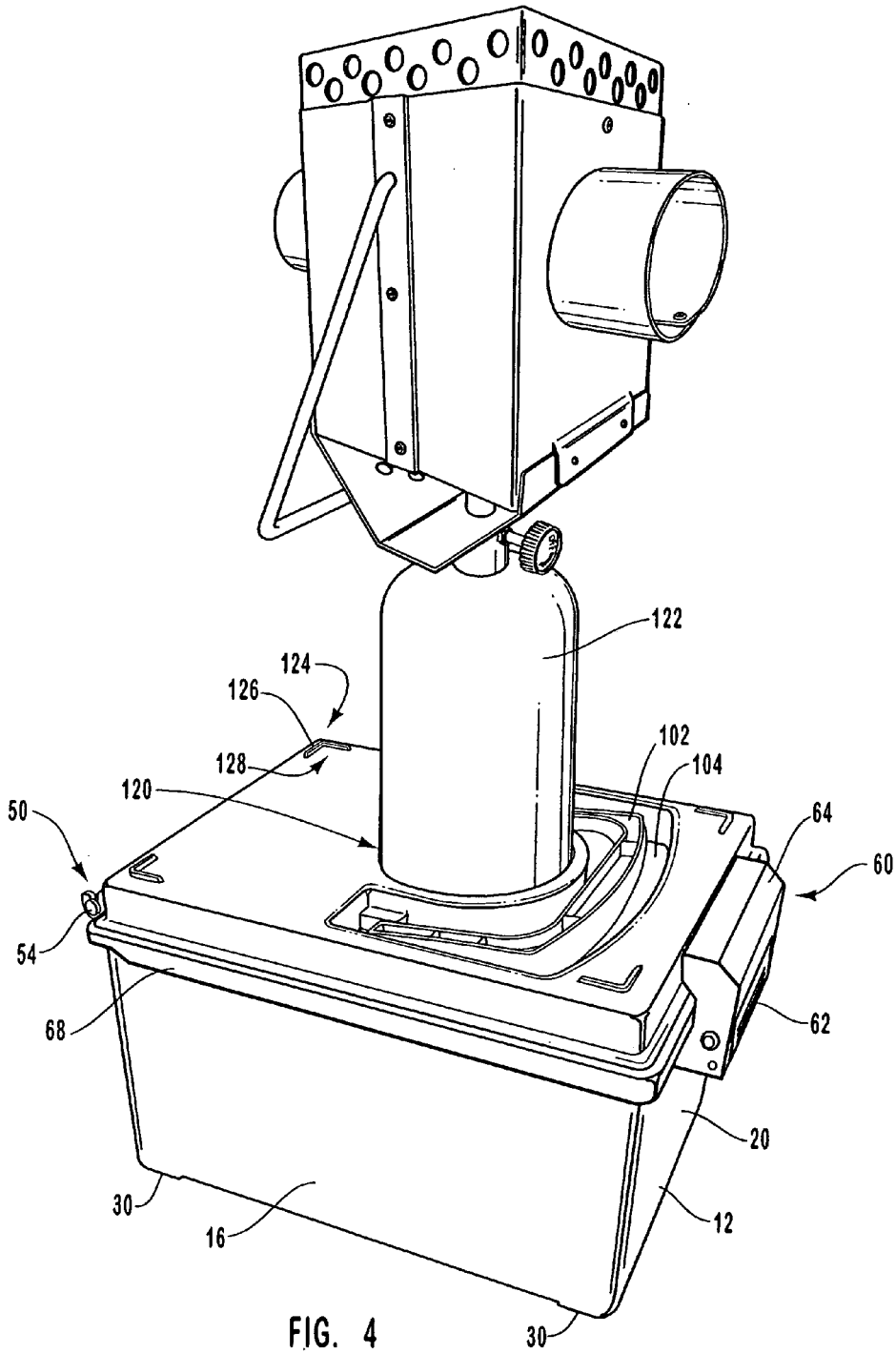
FIG. 4 is another perspective view of the container shown in FIG. 1, illustrating the container used in connection with a portion of a portable air heater for an enclosure such as a tent.

Container 10 may include various optional features intended to help to stabilize container 10 when it is placed on a surface, and to aid in vertically stacking several containers 10 one on top of another. In one embodiment depicted in FIG. 4, body 12 includes one or more optional feet 30 that extend downwardly from the bottom surface of container 10. It will be appreciated that feet 30 may have various sizes and configurations and still perform the function thereof. In one embodiment, feet 30 are generally square-shaped. As depicted in FIGS. 3D and 4, in one embodiment, feet 30 are formed by at least two of the side walls extending below the bottom surface of container 10. Feet 30 are configured to support container 10 in a slightly elevated position. Feet 30 are desirably located in or near the corners of body 12. In a stack of containers 10, the feet 30 may also be used to help retain container 10 in the stacked position by being sized and configured to engage a portion of a lid 14 of a lower-positioned container 10, as will be described below.

Container 10 may also include an optional support structure 31 illustrated in FIG. 3D located on the bottom surface 24 to strengthen the body 12 of the container. Support structure 31 may be used to increase the strength and carrying capacity of container 10 by reinforcing the bottom surface 24. In one possible embodiment, support structure 31 includes a plurality of strengthening ribs that extend along the length and width of the bottom surface of the container 10. One skilled in the art will appreciate that various other configurations of support structures and other types of support structures may be used. Additionally, other portions of container 10, such as the sidewalls or lid, may include similar support structures to increase the strength of container 10.

In one embodiment of container 10 illustrated in FIG. 2, the upper end of walls 16 includes a lip 36 that extends around the open end of enclosure 26 of body 12. Lip 36 comprises an outwardly extending portion 38, an upper surface 40 and an upwardly extending section 42. In one embodiment, upper surface 40 of lip 36 is angled slightly inward as one moves toward upwardly extending section 42, which is located on upper surface 40 of lip 36 along the inside surface of enclosure 26 defined by walls 16 of body 12. In one embodiment, the outer most edge of upper surface 40 of lip 36 and upwardly extending section 42 have generally the same height. In another possible embodiment, upwardly extending section 42 extends above upper surface 40 of lip 36. It will be appreciated that lip 36 of body 12 may have various other configurations and perform the function thereof.

In one embodiment, the interior surfaces of walls 16 defining enclosure 26 are generally smooth to facilitate storage, insertion, and removal of items in enclosure 26 of body 12. In one embodiment, inside surfaces of walls 16 include an optional reinforcing member 44 that is configured to reinforce or strengthen the corners of body 12 of container 10. One possible embodiment of reinforcing member 44 is shown and is disposed near the corners of enclosure 26 defined by walls 16 of body 12. It will be appreciated by one skilled in the art that various other configurations of reinforcing member 44 may be utilized. In one embodiment, reinforcing member 44 is depicted as elongated rib-like members. It will be appreciated that reinforcing member 44 may have various other shapes. Further, as depicted in FIG. 2, in one embodiment reinforcing member 44 comprises two elongated members, one on each side of a corner area. It will be appreciated that, alternatively, the reinforcing structure could be in the form of one wide member to reinforce the corner area or various other numbers and/or shapes of reinforcing structures could be used to provide additional structural support to the corners of body 12.

Container 10 also comprises lid 14, which in one embodiment is capable of moving between a closed position illustrated in FIG. 1 and an open position depicted in FIG. 2. Lid 14 is also capable of being selectively detached entirely from body 12 as will be discussed. Various methods and structures for selectively, rotatably and removably attaching one structure to another are well known in the art. Accordingly, it will be appreciated that various such structures or methods may be used in conjunction with the present invention without departing from its spirit and scope.

In an alternate embodiment, lid 14 does not rotate. Instead, lid 14 is manually lifted away from body 12 to move into the open position so that body 12 is accessible. In this embodiment, lid 14 is mechanically held in the closed position by a second clasp 60. Alternatively, it will be appreciated by one skilled in the art that lid 14 could be formed of a resilient material that can snap fit onto body 12. Accordingly, it will be appreciated by those skilled in the art that various other methods of attaching lid 14 to body 12 may be utilized which would allow lid 14 to move between an open position and a closed position.

Figures 3A, 3B, 3C:
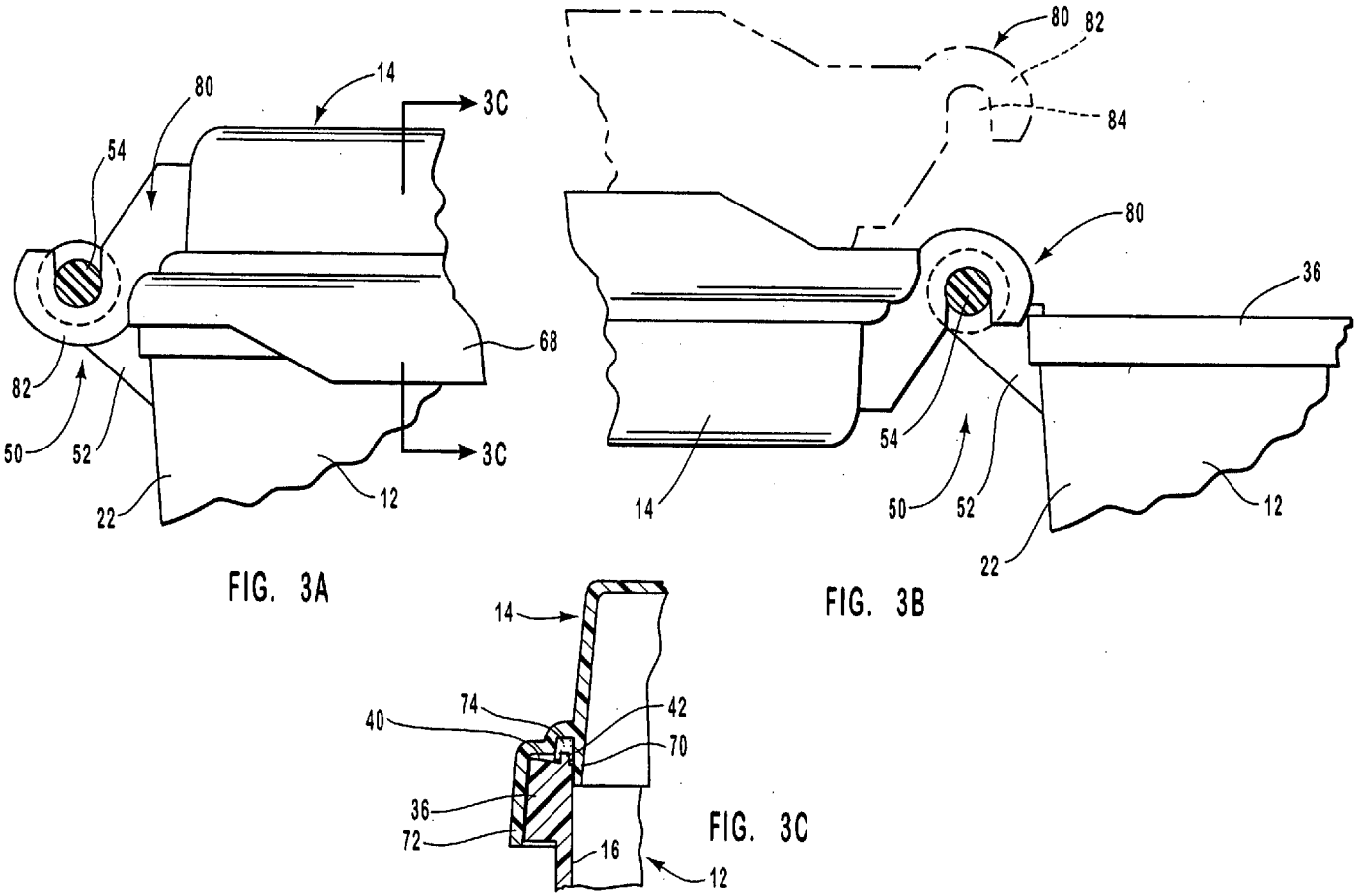
FIG. 3A is an enlarged side view of a portion of the container shown in FIG. 1, illustrating one embodiment of a portion of a pivotal connection of the lid to the body of the container when the lid is in a closed position.
FIG. 3B is an enlarged side view of a portion of the container shown in FIG. 1, illustrating a portion of the pivotal connection of the lid to the body of the container when the lid is in an open position and, as shown in phantom, when the lid is removed from the container.
FIG. 3C is an enlarged partial cross sectional view of the container shown in FIG. 1 in the closed position.

As illustrated in FIGS. 2, 3A and 3B, in one embodiment, container 10 includes hinge portions 50. Hinge portions 50 are configured to selectively, releasably and rotatably connect lid 14 to body 12 of container 10. More specifically, in one possible embodiment, hinge portion 50 comprises pairs of spaced-apart support arms 52, a generally circular connecting member 54 extending there between, and hook-like members 80. More specifically, in one embodiment three (3) pairs of support arms 52 extend outwardly from wall 16. A connecting member 54 extends between each pair of support arms 52. It will be appreciated by one skilled in the art that various other numbers of pairs of support arms 52, connecting member 54, and hook-like members 80 could be used and perform the function of selectively, releaseably and rotatably connecting lid 14 to body 12.

In one possible embodiment depicted in FIG. 2, support arms 52 and connecting member 54 extend outwardly from wall 16 on the left side of body 12 of container 10. It will be appreciated that while in one illustrated embodiment, hinge-forming portions 50 are disposed on the left, they could alternatively be on any of the other walls 16 of body 12 and carry out the intended function thereof.

In one embodiment, hinge portions 50 are integrally formed with body 12 of the container 10. One skilled in the art will appreciate that hinge portions 50 may be attached to the body 12 using any suitable fastening or connecting method, including but not limited to, gluing, welding, and the like. Additionally, one skilled in the art will appreciate that container 10 may include any suitable number of hinge portion 50 depending, for example, upon the size of body 12 or lid 14. Further, support arms 52 may be separated by any suitable distance and correspondingly, connecting member 54 may have any suitable corresponding length. It will be appreciated that in one embodiment, illustrated in FIG. 2, the distance between the pairs of support arms 52 and corresponding length of connecting members 54 are varied. Alternatively, the pairs of support arms 52 and corresponding length of connecting member 54 could all be the same.

Hook-like members 80 are attached to lid 14 so as to cooperate with support arms 52 and connecting members 54. In one embodiment, hook-like members 80 are integrally formed with lid 14. One skilled in the art will appreciate that hook-like members 80 may be attached to lid 14 using any suitable fastening or connecting method, including but not limited to, gluing, welding, and the like. In addition, it will be appreciated by one skilled in the art that the positions of hook-like members 80 and support arms 52 with connecting member 54 could be reversed. In other words, hook-like members 80 could be formed on body 12 and support arms 52 with connecting members 54 could be formed on lid 14 and carry out the intended function thereof.

Turning to FIGS. 3A and 3B, one embodiment of hook-like members 80 are shown in further detail. Hook-like members 80 extend outwardly from lid 14 and comprise curved portion 82 with opening 84 formed therein. It will be appreciated that hook-like members 80 are positioned on lid 14 to cooperate with support arms 52 and connecting members 54. Curved portions 82 and openings 84 are sized and configured to receive connecting members 54 therein to allow lid 14 to be selectively, releaseably and rotatably connected to body 12 of container 10. In particular, curved portions 82 allow connecting members 54 to be disposed in opening 84, thereby allowing lid 14 to be selectively rotated between the open position shown in FIG. 2, and the closed position shown in FIG. 1. Advantageously, lid 14 is also selectively removably attached to body 12. In order to remove lid 14 from body 12, lid 14 is simply rotated such that the connecting members 54 can be removed from opening 84 of curved portion 82 to allow lid 14 to be freely removed from body 12.

Hinge portion 50 comprising pairs of spaced-apart support arms 52, a generally circular connecting member 54 extending there between, and hook-like members 80 is one example of structure capable of performing the function of means for selectively attaching lid 14 to body 12. It will be appreciated that various other types and configurations of structure are available that can perform the function of selectively attaching lid 14 to body 12. Various other types of structure that may be used as such a means for selectively attaching lid 14 to body 12 including, by way of example and not limitation, forming a snap fit or slip fit there between, sliding engagement there between, a hinge like member, nut and bolt, a cooperating opening and pin, and other mechanical coupling methods.

In one embodiment, lid 14 and body 12, when in the closed position illustrated in FIG. 1, optionally seal enclosed space 26 of body 12. It will be appreciated that various methods and structures may be used to seal lid 14 and body 12. As depicted in FIGS. 3A and 3C, in one embodiment, the underside of lid 14 includes an edge 68 along the perimeter thereof that includes an inner flange 70 and outer flange 72. A seal 74 is disposed between inner and outer flanges 70 and 72, respectively. In one embodiment, seal 74 is constructed from a resilient, flexible material such as rubber, and is sized and configured to engage the upper surface 40 of lip 36 on body 12 to create a secure seal between lid 14 and body 12, when lid 14 is in a closed position as seen in FIG. 1. It will be appreciated that various other types of structures and materials could be used to form seal 74. By way of example and not limitation, seal 74 could be formed of various polymers and other materials capable of forming a seal. It will be appreciated that while as depicted in one embodiment, seal 74 has a generally square or rectangular cross sectional configuration, various other configurations of optional seal 74 could be used, such as those with a round, oval, elliptical or the like, cross sectional configuration. In addition, it will be appreciated that a seal may be formed between lid 14 and body 12 without the use of seal 74 depending on the materials comprising lid 14 and body 12, or the particular configuration thereof.

In one embodiment, when lid 14 is in the closed position of FIG. 1 and shown in more detail in FIG. 3C, inner flange 70 is designed to be disposed along or in contact with the remote end of inner surfaces of walls 16 of body 12, and outer flange 72 is designed to be disposed along or contact the outer edge of lip 36. When lid 14 is in a closed position, seal 74 engages upper surface 40 and upwardly extending section 42 of lip 36. In addition, seal 74 is at least partially deformed to create a tight seal between lid 14 and body 12. Thus, inner flange 70, outer flange 72 and seal 74 cooperate with upper surface 40 and upwardly extending section 42 of lip 36 on body 12 to form a tight seal between lid 14 and body 12 when container is in the closed position.

In one embodiment, a generally water-tight or water-resistant seal is created that prevents water from entering or exiting container 10 when lid 14 is closed. Additionally, this seal may be generally air tight to prevent air and other gasses from entering or exiting container 10 when lid 14 is closed. It will be appreciated, however, that in another embodiment, lid 14 and body 12 may not be either air and/or water tight, but container 12 is still capable of performing its intended function.

The present invention also comprises a closing mechanism or clasp 60 for retaining lid 14 in a closed position. It will be appreciated that various methods and structures for retaining lid 14 in the closed position are available and are well known in the art, and any such structures or methods may be used in conjunction with the present invention without departing from its spirit and scope. As depicted in FIGS. 1 and 2, clasp 60 is pivotally attached to wall 16. In one embodiment illustrated in FIGS. 1 and 2, clasp 60 is depicted as being attached to the right side of container 10. It will be appreciated that clasp 60 could be mounted on any of the walls and perform the function thereof. Alternatively, in another embodiment, clasp 60 could be mounted on lid 14 and still perform the function thereof.

In one embodiment, shown in FIG. 2, clasp 60 includes a base 62 which is pivotally attached to body 12 and an arm 64 which is pivotally attached to base 62. Arm 64 includes a lip 66 which, as described below, is configured to grasp outwardly extending teeth 92 (FIG. 5) formed on lid 14. Clasp 60 allows container 10 to be securely closed. Clasp 60 also allows container 10 to be quickly and easily opened by simply lifting base 62, which causes lip 66 to disengage from teeth 92 formed in lid 14, and moves arm 64 away from lid 14.

Figure 5:
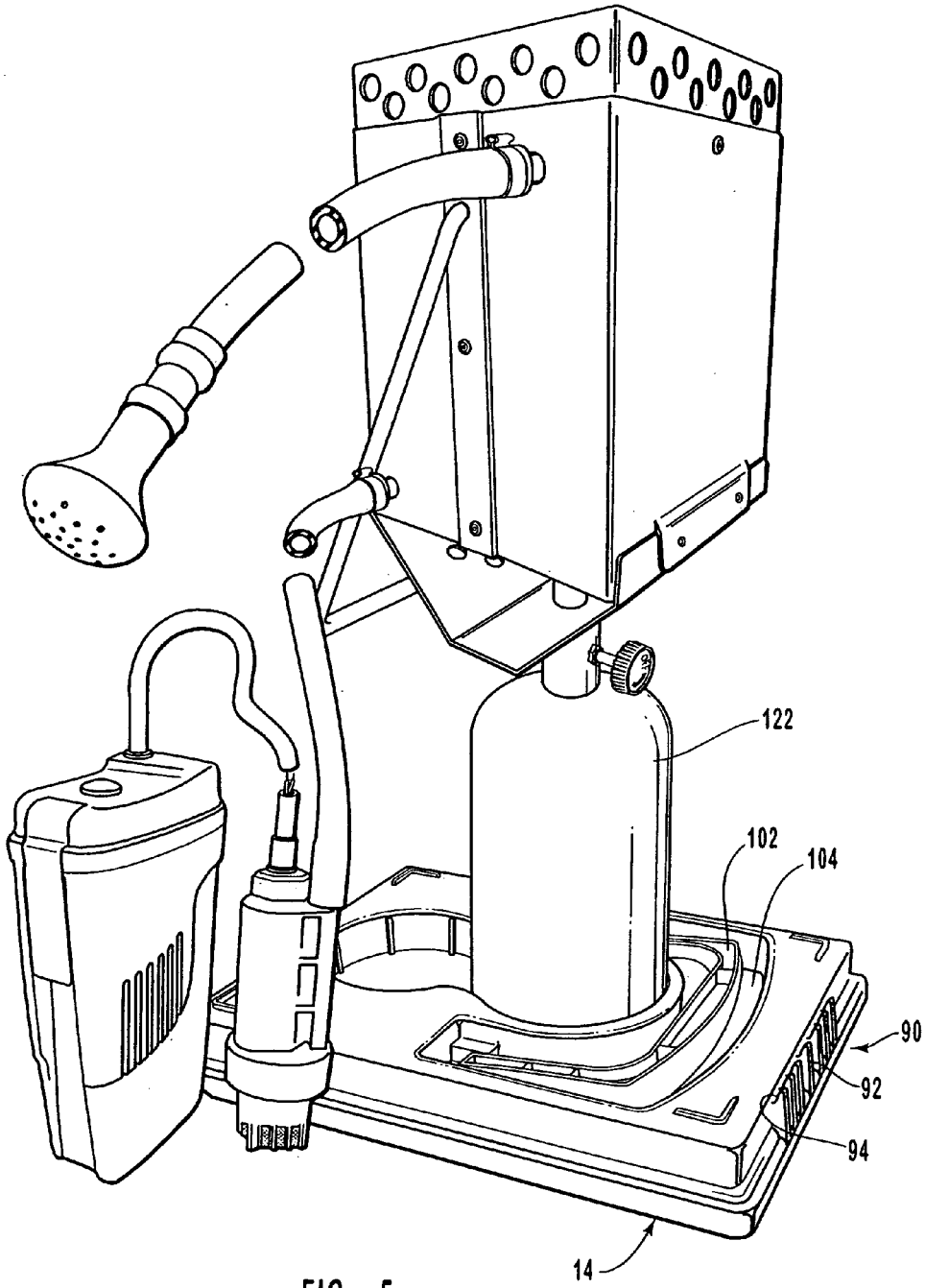
FIG. 5 is a perspective view of a portion of the container shown in FIG. 1, illustrating the container used in connection with a portion of a portable shower.

More specifically, as depicted in FIG. 5, in one embodiment, lid 14 includes a plurality of teeth 90 formed on lid 14 to cooperate with arm 64 of clasp 60. Teeth 92 are sized and configured to engage lip 66 on arm 64 of clasp 60. In one embodiment, teeth 90 include an upwardly extending portion 92 and a receiving notch 94. In order to close lid 14 of container 10, lip 66 of clasp 60 is positioned in receiving notch 94 and, when base 62 of clasp 60 is moved downwardly, lip 66 engages teeth 90 and pulls lid 14 downwardly to securely hold the lid 14 in the closed position depicted in FIG. 1.

In one embodiment, lid 14 has a generally rectangular configuration with dimensions that generally correspond to the length and width of body 12 of container 10. It will be appreciated that lid 14 may have various other configurations as long as it cooperates with body 12 of container 10. In one embodiment, lid 14 has a length of about 12 inches and a width of about 9 inches, but the size of the lid may vary according to the size of body 12 of container 10. Additionally, in one embodiment, the height of lid 14 is about 1 to 2 inches. It will be appreciated that the height of lid 14 may be larger or smaller depending, for example, upon the intended use of the container 10.

As shown in FIG. 1, lid 14 includes an upper surface 100 having a recess 104 formed therein. As depicted, a recessed handle 102 is disposed in recess 104. It will be appreciated that recess 104 and recessed handle 102 may have various configurations and perform the function thereof. The important aspect is that recess 104 and recessed handle 102 be configured to cooperate such that when recessed handle 102 is in recess 104, handle 102 is completely disposed below surface 100 of lid 14. Recessed handle 102 is pivotally attached to lid 14 to facilitate carrying and transport of the container 10.

As shown in FIG. 1, recess 104 and recessed handle 102 are configured so that recessed handle 102 is disposed in recess 104 formed in upper surface 100 of lid 14 when recessed handle 102 is not in use. In one embodiment, recessed handle 102 includes first ends 106 disposed into corresponding apertures or holes (not shown) in lid 14, to pivotally attach recessed handle 102 to lid 14. It will be appreciated that various methods of rotatably attaching recessed handle 102 in recess 104 of lid 14 may be utilized. Recessed handle 102 is securely attached to lid 14 to allow container 10 to be carried when it is filled with equipment or fluids such as water. The design of recessed handle 102 allows containers 10 to be easily stacked. Further, by having recessed handle 102 capable of being disposed in recess 104 formed in lid 14 prevents items from being inadvertently snagged by lid 14.

As illustrated in FIG. 1, a recessed receiving area 120 is also formed in lid 14. Receiving area 120 is sized and configured to receive at least one fuel source (not shown) for portable heating equipment. In one embodiment, receiving area 120 has a generally circular configuration with a diameter of about 4 inches and a depth of about 1 inch. One skilled in the art will appreciate that receiving area 120 may have other suitable dimensions and configurations depending, for example, upon the size of the fuel source to be received within receiving area 120 and the height of lid 14.

In one embodiment depicted in FIG. 1, receiving area 120 is configured so as to receive two fuel sources. Advantageously, this allows lid 14 to be used with either a single fuel source or double fuel source. It will be understood that lid 14 can include any suitable number of receiving areas 120 arranged in any desirable pattern or arrangement. It will be appreciated that receiving area 120 may have various configurations. By way of example, in an alternate embodiment depicted in FIG. 4, receiving area is configured to receive only one fuel source. Returning to FIG. 1, in one embodiment, receiving area 120 includes a plurality of engagement ribs 123 formed along the periphery thereof. Engagement ribs 123 are sized and configured to securely retain the fuel source within receiving area 120. It will be appreciated that engagement ribs 123 may have various other configurations.

As seen in FIGS. 4 and 5, receiving area 120 is preferably sized and configured to support a fuel source 122, such as a pressurized cylinder filled with a flammable gas such as propane. Receiving area 120 supports fuel source 122 in a generally upright position and helps prevent fuel source 122 as well as the portable heating equipment being used with fuel source 122 from falling or being tipped over. FIG. 4 shows portable fuel source 122 and heating equipment being disposed in receiving area 120 of lid 14 on container 10. Alternatively, as illustrated in FIG. 5, lid 14 can be removed from body 12 and then fuel source 122 and portable heating equipment is supported by lid 14.

More specifically, when lid 14 is placed on a generally flat surface such as the ground, lid 14 supports fuel source 122 in a generally upright position and prevents it from falling or tipping over. Receiving area 120 may also be used to support all or a portion of the heating equipment, such as a portable water heater or hot shower shown in FIG. 5 or a portable tent heater shown in FIG. 4, in an upright position.

A portable water heater that is sized and configured to be used with the container 10 is disclosed in co-pending U.S. provisional patent application Ser. No. 60/311,731, filed Aug. 10, 2001 and entitled "Portable Water Heater," which was converted into a U.S. patent application Ser. No. 10/216,496, filed on Aug. 9, 2002, is hereby incorporated by reference in its entirety. A portable tent heater that is sized and configured to be used with container 10 is disclosed in co-pending U.S. provisional patent application Ser. No. 60/311,647, filed Aug. 10, 2001 and entitled "Portable Air Heating System," which was converted into a U.S. patent application Ser. No. 10/215,918, filed on Aug. 9, 2002, is hereby incorporated by reference in its entirety.

A portable multi-purpose heating device that may also be used in connection with container 10 is disclosed in co-pending U.S. provisional patent application Ser. No. 60/312,649, filed on Aug. 15, 2001, and entitled "Portable Multi-purpose Heating Unit," which was converted into a U.S. patent application Ser. No. 10/222,667 filed on Aug. 15, 2002 which is hereby incorporated by reference in its entirety. One skilled in the art will appreciate that other types of portable heating equipment may also be used in conjunction with container 10.

Returning to FIG. 1, in one embodiment, lid 14 includes optional retaining members 124 that are sized and configured to engage optional feet 30 of another container 10 when the containers are in a stacked position. Retaining members 124 assists in stacking the containers 10 by helping to retain the containers in vertical alignment. Advantageously, stacked containers 10 help to minimize storage space required for a plurality of containers. In one embodiment, retaining members 124 include two upwardly extending portions 126 that are joined to generally form a right angle, thereby forming receiving portions 128 for feet 30 of a stacked container.

When in a stacked position, feet 30 of a stacked container 10 contact surface 100 of lid 14 just outside of upwardly extending portion 126 of retaining members 124. Retaining members 124 thereby prevent feet 30 of stacked container 10 from sliding off of surface 100 of lid 14 of the lower container 10. It will be appreciated that alternatively, feet could fit inside upwardly extending portion 12 of retaining members 124. Further, various other configurations of feet 30 and retaining members could be used and still perform the function thereof. For example, an upwardly extending notch could be formed on surface 100 of lid 14 which could be received in a recess formed in foot 30.

In one embodiment, lid 14 and body 12 of container 10 are constructed from a durable, lightweight material such as plastic. Plastic is used because it can be readily molded or formed into the desired shape, and it is relatively easy and inexpensive to manufacture. Plastic is preferably impact resistant to form a durable and rugged container that helps protect the heating system during storage and transportation. It will be appreciated that container 10 may be made of various other materials without effecting the function thereof. By way of example and not limitation container 10 could be formed of various polymers, composites, carbon fiber materials, metals, metal alloys and mixtures thereof as well as other materials capable of being formed into container 10.

Figure 6:
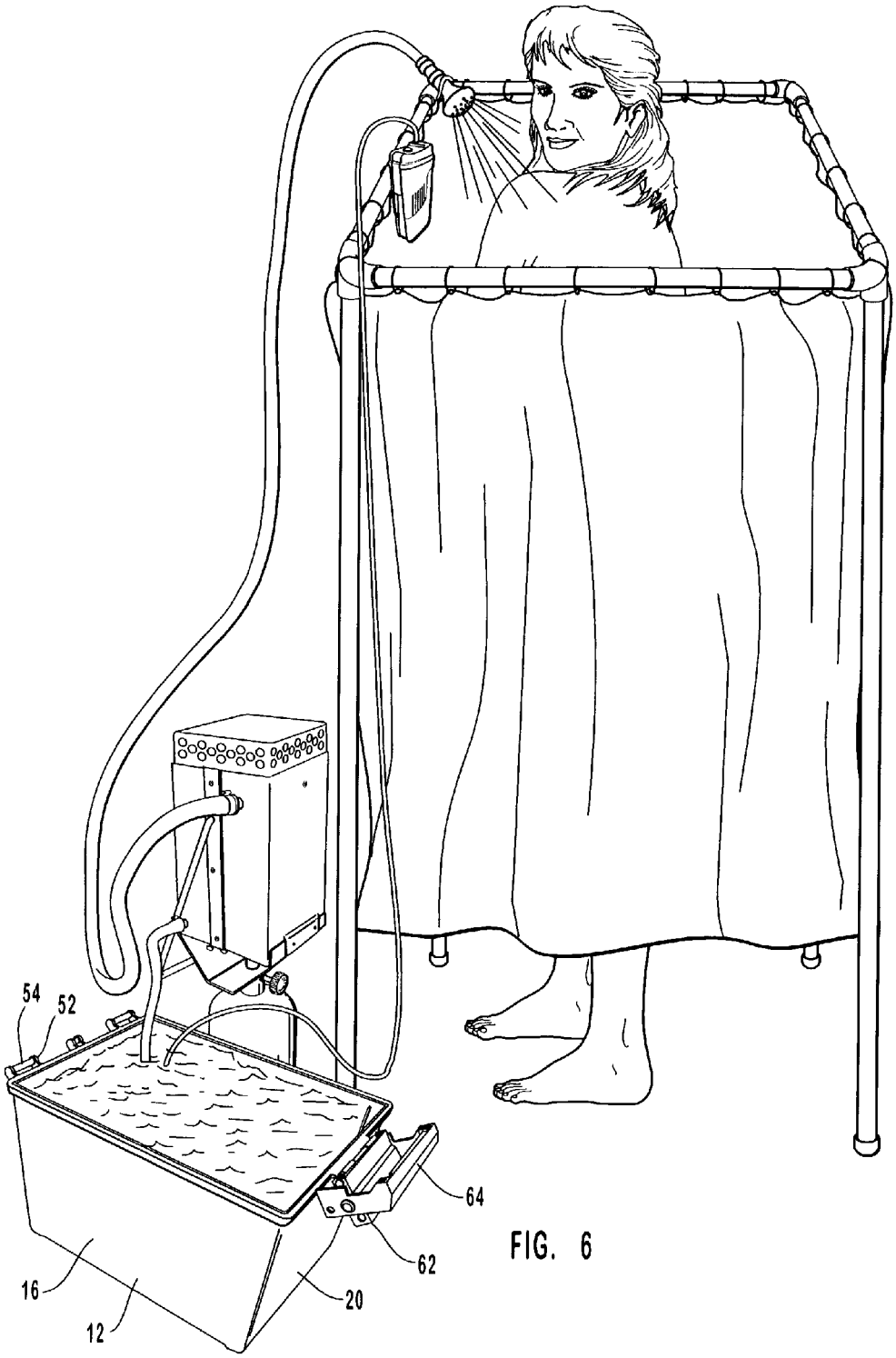
FIG. 6 is a perspective view of another portion of the container shown in FIG. 1, illustrating the container used to hold water for use with a portable shower.

When container 10 is used with a portable shower as seen in FIGS. 5 and 6, for example, the portable water heater for a shower is stored and transported to the desired location in container 10. Container 10 is then opened by opening clasp 60, and lid 14 is removed by pivoting lid 14 with respect to body 12. The components of the portable shower heater are removed from container 10, and shower is at least partially assembled. Body 10 may be filled with water and is positioned on a generally flat surface or portion of the ground. Lid 14, which has been removed from body 12 of container 10, is also placed on a generally flat surface or portion of the ground, near the interior of body 12 filled with water. Fuel source 122 of portable shower heater is inserted into receiving area 120 in lid 14, and the inlet to the portable shower (not shown) is inserted into the interior of body 12. The portable shower is then turned on or ignited, thereby causing heated water to flow from the portable shower.

Advantageously, container 10 stores and transports the portable shower to desired location, while protecting the portable shower from damage. Body 12 of container 10 can then be used to supply water to portable shower and lid 14 supports at least a portion of the shower in a generally upright position. Thus, container 10 is a multifunctional device that is useful while storing, transporting and using the portable shower.

Although the present invention has been described in terms of certain preferred embodiments, other embodiments apparent to those skilled in the art are also intended to be within the scope of the invention. Thus, the described preferred embodiments are to be considered as illustrative and not restrictive. Accordingly, the scope of the invention is intended to be defined only by the following claims. All changes that come within the meaning and range of equivalency of the claims are to be embraced within their scope.

What is claimed is:

1. A container for conveniently storing and transporting a portable heating system when the heating system is not in use, the container comprising:

a body having at least one upwardly extending wall which defines an interior space, said interior space being configured to receive the portable heating system therein;

a lid attached to said body, said lid being capable of assuming an open and a closed position with respect to said body, said lid closing said interior space in said body when said lid is in the closed position, said lid having at least one receiving area formed therein, said receiving area being configured to receive at least a portion of the heating system therein to hold the heating system in a stable position during use of the heating system.

2. The container of claim 1, further comprising a handle for conveniently carrying the container.

3. The container of claim 1, wherein said lid is selectively detachable from said body.

4. The container of claim 2, wherein said handle is moveable between a use position in which said handle is used to carry the container and a storage position when said handle is not in use.

5. The container of claim 2, wherein said lid further having a recess formed therein configured to receive said handle when said handle is in said storage position.

6. The container of claim 1, wherein said lid is pivotally attached to said body by at least one hinge, said at least one hinge allowing said lid to rotate between said open position and closed position, said at least one hinge being configured such that said lid may be selectively removed from said body.

7. The container of claim 1, further comprising at least one engagement rib disposed within said at least one receiving area, said engagement rib being sized and configured to provide further stability to the heating system when the heating system is disposed within said at least one receiving area.

8. The container of claim 1, further comprising a clasp configured to retain the lid in the closed position.

9. The container of claim 1, wherein said at least one receiving area is configured to receive a portion of at least one fuel source.

10. The container of claim 9, wherein said lid and said body form a seal when said lid is in said closed position.

11. The container of claim 1, further comprising at least one clasp for selectively retaining said lid to said body when said lid is in the closed position.

12. A container for conveniently storing and transporting a portable heating system when the heating system is not in use, the container comprising:

a body having at least one upwardly extending wall which defines an interior space, said interior space being configured to receive the portable heating system therein;

a lid releasably attached to said body, said lid being capable of assuming an open and a closed position with respect to said body, said lid closing said interior space in said body when said lid is in the closed position, said lid having at least one receiving area formed therein, said receiving area being configured to receive at least a portion of the heating system therein to hold the heating system in a stable position during use of the heating system.

13. The container of claim 12, wherein said lid is pivotally attached to said body by at least one hinge, said at least one hinge allowing said lid to rotate between said open position and said closed position, said at least one hinge being configured such that said lid may be selectively removed from said body.

14. The container of claim 13, wherein said at least one hinge comprises a hook member and a rotating member.

15. The container of claim 14, wherein said hook member pivots about said rotating member to move said lid between said closed position and said open position.

16. The container of claim 14, wherein said hook member and said rotating member are configured such that said lid may be selectively removed from said body.

17. The container of claim 12, further comprising at least one engagement rib disposed within said at least one receiving area, said engagement rib being sized and configured to provide further stability to the heating system when the heating system is disposed within said at least one receiving area.

18. The container of claim 12, wherein said at least one receiving area is configured to receive a portion of at least one fuel source.

19. The container of claim 12, wherein said lid and said body form a seal when said lid is in said closed position.

20. A container for conveniently storing and transporting a portable heating system when the heating system is not in use, the container comprising:

a lid having a receiving area formed therein, said receiving area being configured to receive at least a portion of the heating system such that the heating system is held in a stable position when the heating system is disposed within said receiving area during use of the heating system;

a body having at least one upwardly extending wall which defines an interior space, said interior space being configured to receive the portable heating system therein;

means for selectively attaching said lid to said body;

said lid further being capable of assuming an open and a closed position with respect to said body, said lid closing said interior space in said body when said lid is in the closed position.

21. The container of claim 20, wherein said means for selectively attaching said lid to said body is configured to allow said lid to move between said open position and said closed position.

22. The container of claim 21, wherein said means comprises a hook member and a rotating member.

23. The container of claim 20, wherein said means comprises at least one hinge, said at least one hinge allowing said lid to be selectively removed from said body.

24. The container of claim 20, wherein said means comprises at least one hinge, said at least one hinge allowing said lid to be selectively removed from said body, said hinge allowing said lid to rotate between said open position and said closed position.

25. A container for conveniently storing and transporting a portable heating system when the heating system is not in use, the container comprising:

a body having at least one upwardly extending wall which defines an interior space, said interior space being configured to receive the portable heating system therein;

a lid releasably attached to said body, said lid being movable between an open position and a closed position with respect to said body, said lid closing said interior space in said body when said lid is in said closed position, said lid having at least one receiving area formed in an upper surface of said lid, said receiving area being configured to receive a portion of the heating system therein to hold the heating system in a stable position during use of the heating system; and a handle for carrying the container.

26. The container of claim 25, wherein said handle being moveably attached to said lid, said handle having a use position in which said handle is used to carry the container and a storage position when said handle is not in use.

27. The container of claim 26, wherein said lid further comprises a recessed portion configured to receive said handle when said handle is in said storage position.

28. The container of claim 26, wherein said lid is pivotally attached to said body by at least one hinge, said at least on hinge allowing said lid to rotate between said open and closed positions, and wherein said at least one hinge allows said lid to be removed from said body when said lid is rotated to an appropriate position.

29. The container of claim 26, wherein said handle is in said use position when said handle is extended.

30. The container of claim 26, further comprising retaining members on an upper surface of said lid, said retaining members being configured to assist in stacking two or more containers in a generally vertical alignment.

* * * * *

UNITED STATES PATENT AND TRADEMARK OFFICE

CERTIFICATE OF CORRECTION

PATENT NO. : 6,929,002 B1
APPLICATION NO. : 10/222732
DATED : August 16, 2005
INVENTOR(S) : Adrian It is certified that error appears in the above-identified patent and that said Letters Patent is hereby corrected as shown below:

Column 1
Line 56, after “destination” insert --for--

Column 3
Line 15, before “very” insert --a--

Column 5
Line 62, after “position;” remove “and”

Column 8
Line 46, change “portion” to --portions--

Column 12
Line 26, change “assists” to --assist--
Line 40, change “12” to --126--
Line 54, change “effecting” to --affecting--

Column 13
Line 11, before “desired” insert --the--
Line 13, before “portable” insert --the--

Signed and Sealed this

Nineteenth Day of June, 2007

JON W. DUDAS
*Director of the United States Patent and Trademark Office*